US005392838A

United States Patent [19]

Bijaoui et al.

[11] Patent Number: 5,392,838

[45] Date of Patent: Feb. 28, 1995

[54] METHOD AND DEVICE FOR THE CONTINUOUS PRODUCTION OF A THREAD BY EXTRUSION INTO A LIQUID

[75] Inventors: Denis Bijaoui, Aubiere; Jean Roche, La Roche Blanche, both of France

[73] Assignee: Compagnie Generale Des Establissements Michelin - Michelin & Cie, Clermont-Ferrand Cedex, France

[21] Appl. No.: 98,279

[22] PCT Filed: Jan. 28, 1992

[86] PCT No.: PCT/FR92/00076

§ 371 Date: Aug. 5, 1993

§ 102(e) Date: Aug. 5, 1993

[87] PCT Pub. No.: WO92/13660

PCT Pub. Date: Aug. 20, 1992

[30] Foreign Application Priority Data

Feb. 8, 1991 [FR] France ..... 91 01575

[51] Int. Cl.[6] ..... B22D 11/06

[52] U.S. Cl. ..... 164/463; 164/423

[58] Field of Search ..... 164/423, 463, 462

[56] References Cited

U.S. PATENT DOCUMENTS 3,845,805 11/1974 Kavesh .
4,523,626 6/1985 Masumoto et al. .
4,617,983 10/1986 Tsubata et al. .
5,000,251 3/1991 Bijaoui et al. .

FOREIGN PATENT DOCUMENTS 60-61147 4/1983 Japan .
60-76255 4/1985 Japan .
63-137550 6/1985 Japan .
60-166147 8/1985 Japan .
61-253147 11/1986 Japan .

OTHER PUBLICATIONS

Vol. 10, No. 331 (M-533) (2387) 11 Nov. 1986, JP, A, 61 135 457 Sumitomo Electric Ind. Ltd.
Vol. 11, No. 205 (M-603) (2652) 3 Jul. 1987, JP, A, 62 24 843 Sumitomo Electric Ind. Ltd.
Vol. 14, No. 97 (M-940) (4040) 22 Feb. 1990, JP, A, 1 306 054 Unitika Ltd.
WO 87/00155 (1987).

*Primary Examiner*—Kuang Y. Lin
*Attorney, Agent, or Firm*—Brumbaugh, Graves, Donohue & Raymond

[57] ABSTRACT

A method and device (1) for the continuous production of a thread (12) by extrusion of a molten material into a cooling liquid (9) applied by centrifuging against the inner wall (10) of a drum (11). The inner wall (10) of the drum (11) comprises a lateral surface (102) which progressively approaches the axis of rotation of the drum (11) in the direction towards the outside (E) of the drum (11). Means (23, 24) are used which make it possible to displace the thread (12) along said surface (102) so that the thread (12) emerges from the drum (11) under the action of the centrifugal force. Threads (12) obtained by this method and this device, these threads being, for instance, amorphous metal threads used to reinforce automobile tires.

12 Claims, 3 Drawing Sheets

METHOD AND DEVICE FOR THE CONTINUOUS PRODUCTION OF A THREAD BY EXTRUSION INTO A LIQUID

BACKGROUND OF THE INVENTION

The present invention relates to methods and devices which make it possible to obtain threads by casting in a liquid. Such threads are, for instance, metal threads, particularly threads of amorphous alloys.

It is known to produce amorphous threads by projecting a jet of molten alloy into a liquid cooling layer, for instance a layer of water, applied by centrifugal force against the inner wall of a rotary drum. Such methods are described, for instance, in U.S. Pat. Nos. 3,845,805, 4,523,626 and French Patent 2 636 552. The Japanese Patent Application published under No. 63-137550 describes such a method in which use is made of devices at the end of the drum in order to separate a given number of layers of threads. The thread is extracted upon the stopping of the drum, so that this method cannot be used in continuous operation.

In order that a method of centrifugal casting in a drum can be used in continuous operation, it is necessary to have the thread emerge from the drum as it is formed. Various methods have been described for this purpose. It has been proposed, for instance, to use magnetic devices in order to apply the thread against a coil arranged outside the cooling liquid, these devices possibly furthermore employing a radially moving lever which is driven by the drum. Such methods are described, for instance, in U.S. Pat. No. 4,617,983, in the Japanese Patent Application published under No. 62-89526, and in the international application published under No. WO 87/155. These devices are complicated to use and may lead to instabilities of the film of water which are prejudicial to the continuity of the thread. Water and thread evacuation devices have been described, for instance, in the Japanese Patent Applications published under Nos. 60-61147, 60-76255, 60-166147, and 61-253147. These devices are also complicated to use and, furthermore, they raise sealing problems which are difficult to solve.

SUMMARY OF THE INVENTION

The purpose of the present invention is to provide a method and a device which make it possible continuously to extract in simple manner a thread produced by centrifuging in a drum without sealing problems arising. The method in accordance with the invention for the continuous production of a solid thread by extrusion of a molten material into a cooling liquid applied by centrifugal force against the inner wall of a drum is characterized by the following features:

a) a drum capable of rotating around an axis is used; the inner wall of the drum, which is in contact with the centrifuged liquid, has a lateral surface which progressively approaches the axis of rotation in the direction towards the outside of the drum;

b) means are used which make it possible to displace the thread along said surface in such a manner that the thread then moves away from said surface, emerging from the drum under the action of the centrifugal force.

The invention also concerns a device for the continuous obtaining of a solid thread by extrusion of a molten material into a cooling liquid applied by centrifuging against the inner wall of a drum, the device being characterized by the following features:

a) it comprises a drum and means making it possible to turn the drum around an axis; the inner wall of the drum, intended to come into contact with the centrifuged liquid, has a lateral surface which progressively approaches the axis of rotation in the direction towards the outside of the drum;

b) it comprises means making it possible to displace the thread along said surface, said means being so arranged that the thread then moves away from said surface, emerging from the drum under the action of the centrifugal force.

The invention also concerns threads obtained by the method or device previously described.

The invention also concerns articles reinforced with these threads, such articles being, for instance, belts, hoses or tires.

The invention will be easily understood by means of the following non-limitative examples and the diagrammatic figures relating to these examples.

Figure 2:
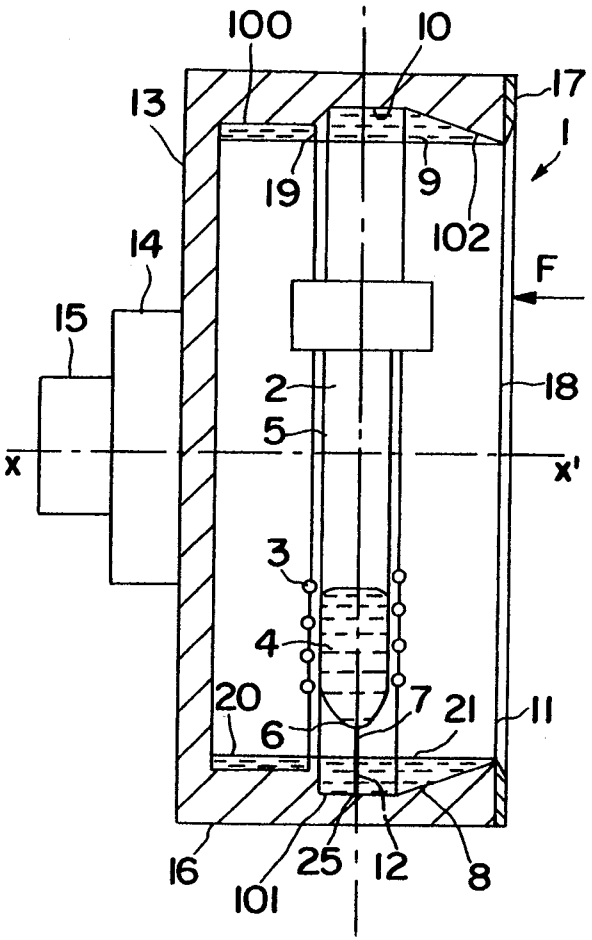
FIG. 2 is a cross-sectional view of the device shown in FIG. 1, this section being indicated by the line segments II in FIG. 1.
Figure 1:
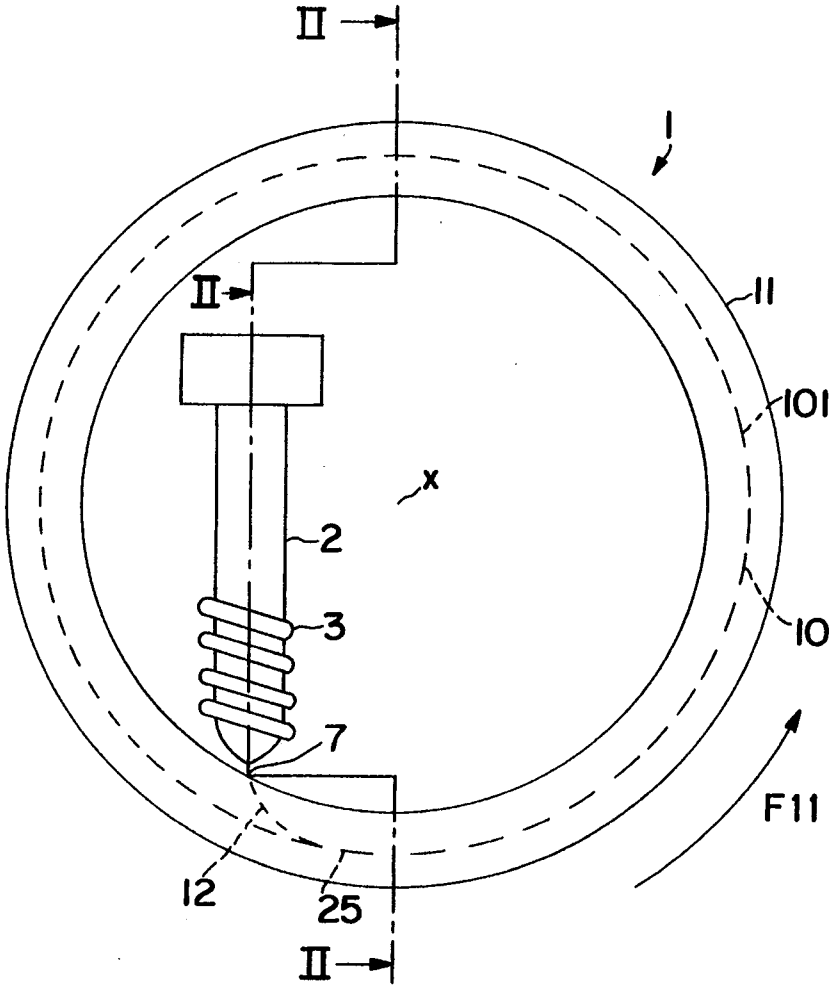
FIG. 1 is a front view of a device according to the invention with a drum rotating around an axis, the view of FIG. 1 being taken in the direction of the arrow F shown in FIG. 2.
Figure 3:
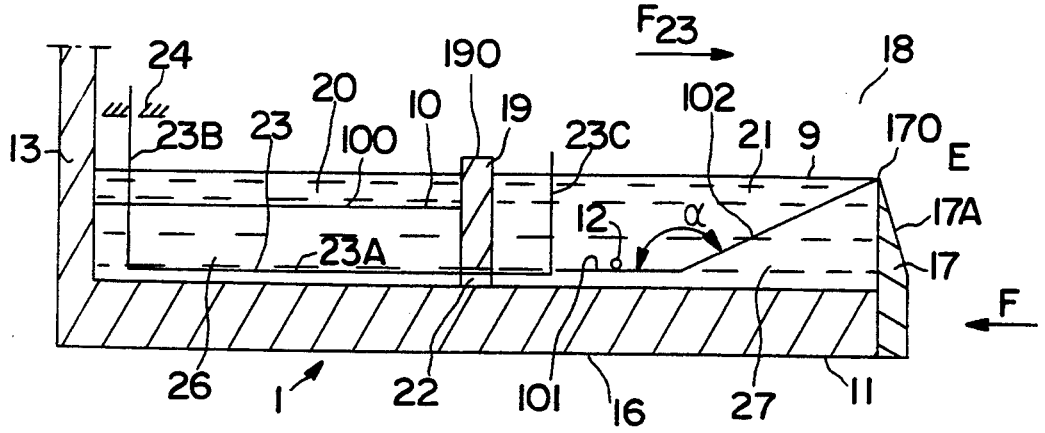
Figure 4:
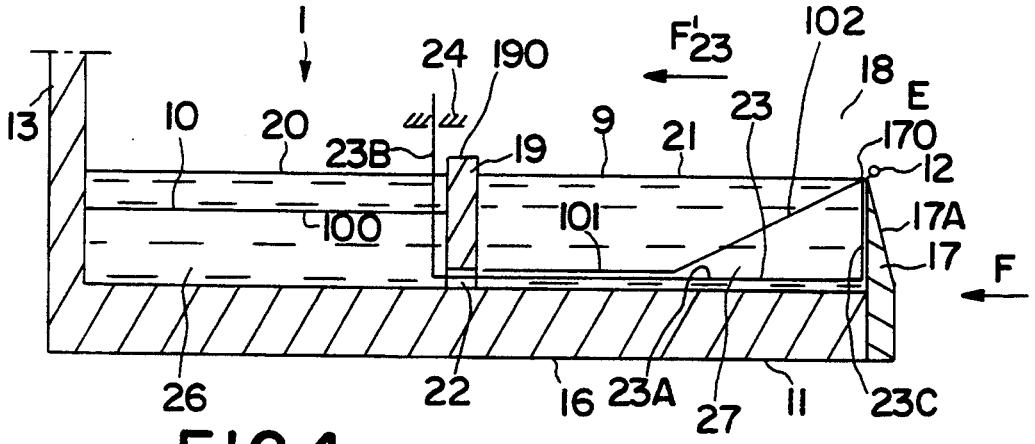
Figure 5:
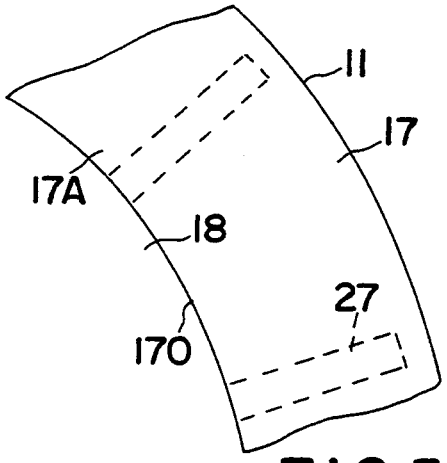
Figure 6:
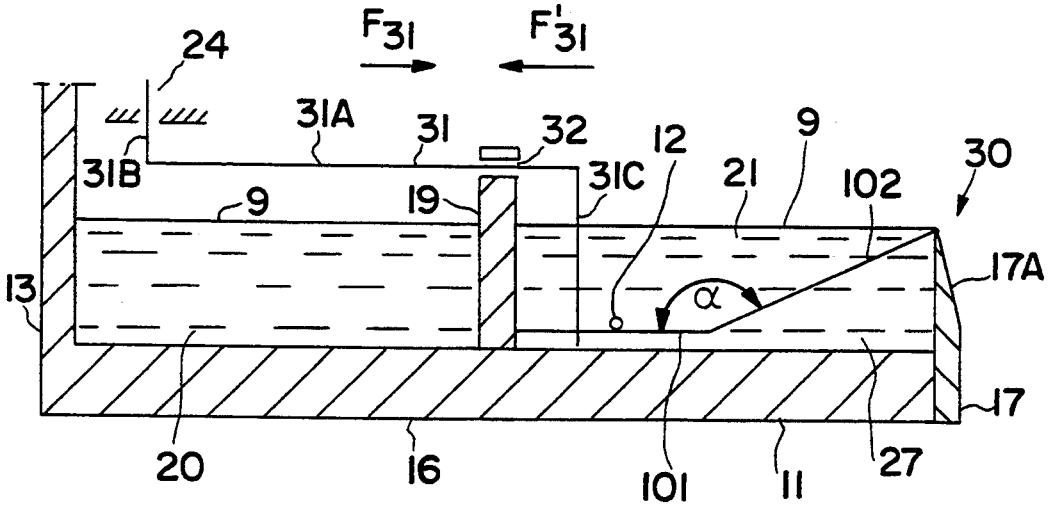

Each of FIGS. 3 and 4 shows, in greater detail, a part of the drum of the device shown in FIGS. 1 and 2, with a pusher, each of these figures corresponding to one position of this pusher, these figures being sections taken along planes passing through the axis of rotation of the drum;

FIG. 5 shows, in front view, a part of this drum, this view being taken along the arrow F shown in FIGS. 2 to 4;

FIG. 6 shows a part of the drum of another embodiment of the invention, along a section taken in a manner similar to FIGS. 3 and 4.

DESCRIPTION OF PREFERRED EMBODIMENTS

FIGS. 1 and 2 show a device in accordance with the invention for the production of amorphous metal threads. This device 1 comprises a reservoir 2 formed of a crucible around which there is located the induction coil 3 which makes it possible to melt the amorphizable metal alloy 4 having a base of iron which is contained within the reservoir 2. A gas 5 under pressure, for instance argon, makes it possible to cause the liquid alloy 4 to flow through the nozzle 6 so as to obtain a jet 7, this gas 5 being inert with respect to the alloy 4. This jet 7 arrives at the layer 8 of cooling liquid 9 which is applied against the inner wall 10 of a drum 11, this liquid 9 being, for instance, water. The jet 7 then solidifies very rapidly so as to form the amorphous metal thread 12. The drum 11 turns around its axis in the direction of the arrow $F_{11}$, this axis being marked xx' in FIG. 2 and x in FIG. 1, and the centrifugal force thus obtained applies the cooling liquid 9 in a layer 8 against the inner wall 10. FIG. 1 is a front view, seen from the outside of the drum, in the direction indicated by the arrow F in FIG. 2, and FIG. 2 is a section taken in two planes, one of which passes through the axis xx' while the other is parallel to the axis xx', this section being indicated by the straight line segments II in FIG. 1.

FIGS. 3, 4 and 5 each show in greater detail a part of the drum 11 with the means in accordance with the invention for extracting the thread 12. FIGS. 3 and 4 are sections taken in a plane passing through the axis xx', FIG. 5 being a front view, seen from the outside of the drum, this view being taken along the arrow F of FIGS. 2 to 4.

In FIGS. 3 and 4, the outside of the drum 11 is represented by the letter E. The drum 11 comprises a substantially flat plate 13 perpendicular to the axis xx' and to which there is fastened a shaft 14 driven by the motor 15 in order to drive the drum 11 in rotation around the axis xx' (FIG. 2). The drum 11 comprises a plate 16 having the general shape of a cylinder which revolves about the axis xx' and a plate 17, substantially parallel to the plate 13 and having the general shape of a ring with axis xx', defining an opening 18 arranged on the side of the exterior E. The drum 11 furthermore comprises an intermediate plate 19 arranged between the plates 13 and 17, this plate 19, which is perpendicular to the axis xx' and substantially parallel to the plates 13 and 17, having substantially the shape of a ring with axis xx'. In the sectional views of FIGS. 3 and 4, the end 170 of the plate 17 and the end 190 of the plate 19 are the closest to the axis xx' and both of them are practically at the same distance from the axis xx'.

Upon the rotation of the drum 11, the plates 13, 17, 19 define two zones 20, 21 in which the liquid 9 is present, the zone 20 being limited by the plates 13, 16 and 19 and the zone 21, which is towards the outside E, being limited by the plates 16, 17, 19. The thread 12 is formed in the zone 21. The plate 19 is provided with openings 22 through each of which a pusher 23 passes. A single one of these pushers is shown in FIGS. 3 and 4. This pusher 23 is formed of a rod having a linear part 23A which is substantially parallel to the axis xx' and two linear ends 23B, 23C parallel to each other and perpendicular to the part 23A, these parts 23B, 23C being substantially disposed in a plane containing the axis xx'. The part 23B is disposed in the-zone 20 and it is in contact with a cam 24. The part 23C is disposed in the zone 21. The arrangement of all the pushers 23 is similar to the one which has just been described, these pushers being distributed uniformly all around the drum 11.

The inner wall 10 of the plate 16 is in contact with the liquid 9. In the zone 20, this inner wall, designated 100, has the shape of a cylinder of revolution with axis xx'. In the zone 21, the inner wall 10 has a surface, designated 101, in the vicinity of the plate 19 which has the shape of a cylinder of revolution with axis xx' and it has a lateral surface 102, in the vicinity of the plate 17, which progressively approaches the axis xx' in the direction towards the opening 18, that is to say, towards the outside E of the drum 11. This lateral surface 102 has, for instance, the shape of a cone of axis xx', this cone flaring out in the direction of the plate 13. The liquid 9 is applied against the surfaces 100, 101, 102 by the centrifugal force upon the rotation of the drum 11.

In the sectional views of FIGS. 3 and 4, the surfaces 101, 102 are, for example, linear and they form the angle $\alpha$ with each other (FIG. 3).

The thread 12 is formed in the zone 21 by cooling of the jet 7. The contact of the thread 12 with the wall 10 takes place on the surface 101 at the point 25 (FIGS. 1 and 2). In order to facilitate the heat exchanges, the plates 13, 16, 17, 19 are, for instance, made of metal.

The pushers 23 initially have an arrangement such that their part 23C, in the zone 21, is arranged in the vicinity of the plate 19. Upon the rotation of the drum 11, each pusher 23, which is driven in rotation with the drum 11 and guided by the cam 24, is displaced towards the surface 102, sliding in an opening 22 in the plate 19 and in grooves 26, 27 made in the plate 16, in zones 20, 21, respectively. Upon this displacement parallel to the axis xx', indicated diagrammatically by the arrow $F_{23}$ in FIG. 3, the end 23C of the pusher 23 comes into contact with the thread 12 and pushes it on the surface 101 in order to bring it into contact with the surface 102, whereupon this end 23C pushes the thread 12 towards the opening 18 so that this thread follows the lateral inclined surface 102. The thread 12 thus arrives at the opening 18 and, under the action of the centrifugal force, it emerges from the drum 11 moving away from the lateral surface 102. The outer surface 17A of the plate 17 has, for instance, a conical shape in the vicinity of the end 170, approaching the plate 13 when it approaches the axis xx' (FIGS. 3 and 4), so as to facilitate this emergence. It is then possible to collect the thread 12, for instance in order to wind it on a bobbin, the device 1 thus operating continuously. The means which permit the winding of the thread 12 outside the drum 11 have not been shown in the drawing for purposes of simplification. The cam 24 then causes the return of the pusher 23 to its initial position, the end 23C being no longer in contact with the thread 12; this movement is indicated diagrammatically by the arrow $F'_{23}$ in FIG. 4 FIG. 3 shows a pusher 23 in its initial position when its end 23C is in the vicinity of the plate 19, and FIG. 4 shows the same pusher in its final position, that is to say when the end 23C is furthest from the plate 19 and is in contact with or in the vicinity of the plate 17. The openings 22 and the grooves 26, 27 serve to guide the pushers 23 upon their above-described displacements, so that their linear parts 23A remain substantially parallel to the axis xx' and their linear parts 23B, 23C remain substantially radial, that is to say substantially in a plane passing through the axis xx' for each pusher, the number of these planes being equal to the number of the pushers 23, FIGS. 3 and 4 being taken along one such plane.

Each pusher 23 carries out a complete cycle (start from the initial position and return to the initial position) during one rotation of the drum 11, the cam 24 being so adapted that the action of the pushers 23 on the thread 12 in order to cause it to emerge from the drum 11 takes place after the point 25 in the direction of rotation of the drum. It is not necessary for the position of contact of the pushers with the thread 12 to be determined with any great precision. It is sufficient merely that the thread 12 be ejected from the drum 11 before it has carried out a complete revolution in the drum. The device 1 can therefore operate without a device for the detecting of the point 25.

The role of the zone 20 is simply to avoid using sealing devices for the openings 22 in which the pushers 23 slide, the liquid 9 passing without disturbance from the zone 20 to the zone 21, or conversely, via the openings 22. It is possible to dispense with the use of the zone 20 by providing sealing packings for these openings 22 so as to avoid the emergence of the liquid 9 from the zone 21 while permitting the movement of the pushers 23, but this solution is more complicated that the one which has been described.

The invention therefore, in a very simple manner, permits continuous operation of the device 1 without there being any sealing problem and without the use of magnetic devices or devices for detecting the position of the thread 12.

EMBODIMENT

A thread of amorphous alloy is made in accordance with the invention with the device 1 employing the following conditions:

- nature of the alloy 4: amorphizable alloy having a base of iron, nickel, silicon and boron, the composition of the alloy being approximately as follows (atomic %): Fe: 38; Ni: 40; Si: 10; B: 12;
- the weight of this alloy in the reservoir 2 is 100 grams;
- the melting point of the alloy 4 is about 1050° C.; this molten alloy is maintained at a temperature of 1100° C. in the reservoir 2;
- characteristics of the device 1: inside diameter of the drum 11 (diameter of the cylindrical part 101): 480 mm;
- depth of the water in contact with the part 101: 14 mm;
- value of $\alpha$: 150°;
- number of pushers 23: 60;
- speed of rotation of the drum: 350 rpm;
- temperature of the water 9: about 6° C.;
- displacement of each pusher 23 along the axis xx' in the direction of the arrow $F_{23}$: 35 mm.

Several hundred meters of a thread 12 of diameter 120 μm are produced continuously without a break in the thread; this thread having a rupture strength of 2800 MPa and an elongation upon rupture of about 2%.

In the device 1, the pushers 23 were so arranged that their linear part 23A is disposed in contact with the liquid 9 both in zones 20 and 21, the openings 22 being also in contact with this liquid.

FIG. 6 shows a portion of the drum 11 of another device 30 in accordance with the invention, this FIG. 6 being a section taken in a manner similar to FIGS. 3 and 4. From this FIG. 6 it is seen that the pusher 31 has a linear part 31A parallel to the axis xx' and two linear parts 31B, 31C perpendicular to the part 31A and arranged substantially in a radial plane. The part 31A slides in the opening 32 of the intermediate plate 19, in accordance with the opposite arrows $F_{31}$, $F'_{31}$, parallel to xx'. The opening 32 is not in contact with the liquid 9, the part 31B in contact with the cam 24 and the part 31A thus moving without being in contact with the liquid 9. Only the part 31C, intended to push the thread 12 on the surface 102 is in contact with the liquid 9. There is therefore no sealing problem between the zones 20, 21.

Moreover, the groove 26 becomes useless in the zone 20 and there is therefore only one groove 27 per pusher 31 in the zone 21, which simplifies the production. The zone 20 can thus be without liquid 9 if desired in order to limit the weight or it can contain liquid 9 which then serves as thermal flywheel. One can even eliminate the zone 20, the plate 19 constituting, for instance, the plate 13.

The invention is not limited to the production of amorphous metal threads. It applies to the production of non-amorphous metal threads, for instance, microcrystalline threads, or to the production of nonmetallic threads, for instance threads of inorganic or organic material.

Of course, the invention is not limited to the embodiments which have been described above. Thus, for instance, the thread,-upon its extrusion, can be placed in contact with the lateral surface which progressively approaches the axis of rotation, the inner wall of the drum having, for instance, a generally conical shape without cylindrical part. Furthermore, means other than the pushers described above can be used to displace the threads, and several cams can be used for each device, or means other than cams can be used.

We claim:

1. A method for the continuous production of a solid thread by extrusion of a molten material into a cooling liquid applied by centrifuging against the inner wall of a drum comprising:

(a) rotating a drum about an axis, the drum having an inner wall in contact with a centrifuged liquid, the inner wall comprising a lateral surface which progressively approaches the axis of rotation in a direction towards the outside of the drum;

(b) using means to displace the thread along said surface, so that the thread moves away from said surface emerging from the drum under the action of the centrifugal force.

2. A method according to claim 1, in which the means for the displacement of the thread comprise pushers.

3. A method according to claim 2, including actuating the pushers by at least one cam.

4. A method according to claim 2, in which the drum is separated into two zones by a plate and including sliding the pushers in openings of the plate.

5. A method according to claim 2, in which the drum is separated into two zones containing cooling liquid by a plate perpendicular to the axis of the drum, said plate being provided with openings in which the pushers slide, one of these zones, directed towards the outside of the drum, being intended to receive the thread, and the liquid being able to pass from one zone to the other through the openings.

6. A method according to claim 1, including manufacturing a metal thread of amorphous alloy.

7. A device for the continuous production of a solid thread by extrusion of a molten material into a cooling liquid comprising:

(a) a drum and means for rotating the drum around an axis, the drum having an inner wall, intended to contact a centrifuged cooling liquid, the inner wall having a lateral surface which progressively approaches the axis of rotation in the direction towards the outside of the drum;

(b) means for displacing the thread along said surface, said means being so arranged that the thread then moves away from said surface emerging from the drum under the action of centrifugal force.

8. A device according to claim 7, in which the means for the displacement of the thread comprise pushers.

9. A device according to claim 8, in which the means for the displacement of the thread comprise at least one cam for actuating the pushers.

10. A device according to claim 8, including a plate provided with openings in which the pushers slide.

11. A device according to claim 8, including a plate separating two zones of the drum in which cooling liquid is contained, said plate being perpendicular to the axis of the drum and being provided with openings in which the pushers slide, one of said zones, directed towards the outside of the drum receiving the thread, and the liquid being capable of passing from one zone to the other through the openings.

12. A device according to claim 7 for producing a metal thread of amorphous alloy.

* * * * *